US008215375B2

(12) United States Patent
Ebner et al.

(10) Patent No.: US 8,215,375 B2
(45) Date of Patent: Jul. 10, 2012

(54) CONTINUOUS CASTING PLANT HAVING AT LEAST ONE MULTIFUNCTION ROBOT

(75) Inventors: Helmut Ebner, Naarn (AT); Johann Pöppl, Kirchschlag (AT); Armin Schertler, Guntramsdorf (AT); Susanne Tanzer, Leonding (AT); Heinrich Thöne, Linz (AT); Franz Wimmer, Riedau (AT)

(73) Assignee: Siemens Vai Metals Technologies GmbH (AT)

( * ) Notice: Subject to any disclaimer, the term of this patent is extended or adjusted under 35 U.S.C. 154(b) by 717 days.

(21) Appl. No.: 11/993,346

(22) PCT Filed: Jun. 8, 2006

(86) PCT No.: PCT/EP2006/005464

§ 371 (c)(1),
(2), (4) Date: Mar. 25, 2008

(87) PCT Pub. No.: WO2007/057061

PCT Pub. Date: May 24, 2007

(65) Prior Publication Data

US 2008/0314938 A1 Dec. 25, 2008

(30) Foreign Application Priority Data

Jun. 20, 2005 (AT) ..... A1035/05

(51) Int. Cl.

| | |
|---|---|
| ***B22D 11/00*** | (2006.01) |
| *B22D 41/00* | (2006.01) |
| *B22D 41/50* | (2006.01) |
| *B23K 7/00* | (2006.01) |
| *C21B 7/00* | (2006.01) |
| *C21B 13/06* | (2006.01) |

(52) U.S. Cl. ..... 164/418; 222/591; 266/50; 266/142

(58) Field of Classification Search ..... 164/418; 222/591; 266/50, 142

See application file for complete search history.

(56) References Cited

U.S. PATENT DOCUMENTS 4,946,337 A * 8/1990 Tonai et al. ..... 414/744.5

(Continued)

FOREIGN PATENT DOCUMENTS

EP 0 262 706 4/1988

(Continued)

OTHER PUBLICATIONS

PCT International Search Report dated Sep. 6, 2005 issued in corresponding PCT International Appln. No. PCT/EP2006/005464 filed Jun. 8, 2006.

(Continued)

*Primary Examiner* — Jessica L Ward
*Assistant Examiner* — Alexander Polyansky
(74) *Attorney, Agent, or Firm* — Ostrolenk Faber LLP

(57) ABSTRACT

In order to be able to carry out a multiplicity of continuously recurring activities at a continuous casting plant having at least one multifunction robot for implementing a plurality of different process-controlled or automated interventions at the continuous casting plant, at least one working region at the continuous casting plant and at least one multifunction robot assigned to each working region. The multifunction robot is arranged on a pivotable arm at a rotary column fastened to the pouring platform of the continuous casting plant and the robot can be pivoted with the pivot arm between a retraction position and a working position. The robot is also movable with respect to its arm.

19 Claims, 7 Drawing Sheets

U.S. PATENT DOCUMENTS

| | | | | |
|---|---|---|---|---|
| 5,007,762 | A * | 4/1991 | Duran | 403/341 |
| 5,067,553 | A | 11/1991 | Nakajima | 164/412 |
| 5,195,388 | A * | 3/1993 | Zona et al. | 74/479.01 |
| 5,360,051 | A * | 11/1994 | Takahashi et al. | 164/155.3 |
| 6,715,535 | B2 * | 4/2004 | Kahn et al. | 164/136 |
| 2005/0196263 | A1 * | 9/2005 | Tamura | 414/744.5 |
| 2008/0058981 | A1 * | 3/2008 | Andretsch et al. | 700/146 |

FOREIGN PATENT DOCUMENTS

| | | |
|---|---|---|
| EP | 0 371 482 | 8/1998 |
| JP | 62-63059 | 3/1987 |
| JP | 2-104455 | 4/1990 |
| JP | 2-151355 | 6/1990 |
| JP | 2-237784 | 9/1990 |
| JP | 2-251346 | 10/1990 |
| JP | 03 071959 | 6/1991 |
| JP | 03-353900 | 12/1991 |
| JP | 5-169206 | 7/1993 |
| JP | 07-016739 | 1/1995 |
| JP | 9-47995 | 2/1997 |
| JP | 2004-42090 | 2/2004 |
| JP | 2008-500176 | 1/2008 |
| WO | WO 2005/118182 | 12/2005 |

OTHER PUBLICATIONS

PCT International Written Opinion dated Oct. 4, 2007 issued in corresponding PCT International Appln. No. PCT/EP2006/005464 filed Jun. 8, 2006.

* cited by examiner

CONTINUOUS CASTING PLANT HAVING AT LEAST ONE MULTIFUNCTION ROBOT

CROSS REFERENCE TO RELATED APPLICATION

The present application is a 35 U.S.C. §§371 national phase conversion of PCT/EP2006/005464, filed Jun. 8, 2006, which claims priority of Austrian Application No. A1035/05, filed Jun. 20, 2005. The PCT International Application was published in the German language.

The invention relates to a continuous casting plant having at least one multifunction robot, preferably having at least two multifunction robots, for carrying out a plurality of different process-controlled or automated actions on the continuous casting plant. At least one working region is defined on the continuous casting plant, and each working region is assigned at least one multifunction robot. The multifunction robot is arranged on a pivoting arm of a pivoting device.

BACKGROUND OF THE INVENTION

Multifunction robots are employed in continuous casting plants in order to carry out with high precision activities which are difficult and particularly hazardous for the operating personnel, in the region near liquid metal and under the effects of heat and dust. According to current demand in the operating situation, multifunction robots of this type are set up for carrying out a series of different activities in their effective range. The multifunction robot is preferably designed as a 6-axis robot.

The field of use embraces all types of continuous casting plants for the production of metal strands of any desired cross section from liquid metal, in particular from liquid steel. These are preferably single-strand or multistrand casting plants for the production of metal strands having slab, bloom or billet cross sections and of metal strands having any desired profile cross sections.

A multifunction robot of the generic type is already known from WO 2005/118182 A1. This robot is assigned a specific running gear and a runway, so that it can assume different positions of use. According to a particular embodiment, this running gear is additionally assigned a pivoting gear with a jib, on the projecting end portion of which a multifunction robot is positioned. By means of this arrangement, the multifunction robot can not only be brought into a position of use determined by the running gear, but can be pivoted between two or more working regions by means of the pivoting arm.

U.S. Pat. No. 5,360,051 or EP 0 371 482 B1 discloses a robot on the casting platform of a continuous casting plant, which robot is anchored in a stationary manner there and is equipped with an image acquisition and evaluation device for detecting its working surroundings in the region of a continuous mold. In particular, this robot is set up for the casting powder feed, for inert gas injection, for slag whisker removal and for the detection of bath level abnormalities. An essential disadvantage of this system is the stationary positioning in the region near the mold and the resulting obstruction of the operating personnel in the event of sudden faults in casting operation which require rapid intervention concentrated on the particular problem.

JP-A 5-169206 and JP-A 3-353900 disclose multifunction robots for sealing off a dummy strand in the mold of a continuous casting plant before the start of casting, each of these robots being movable between a position of use and a standby position on a railborne vehicle on the casting platform. JP-A 07-01639 likewise shows a multifunction robot which is placed on the running frame of a rail vehicle and is employed specially for the change of casting spouts. Further, it is known from JP-A 3-071959 to arrange movably on two separate rail tracks two robots which independently of one another carry out activities on the casting ladle and on the tundish. Although robots placed on a rail vehicle make it possible to displace the robots into a retraction region on the casting platform, with the result that access for the operating personnel is improved, the running rails nevertheless remain, which continue to constitute a stumbling place and the risk of accidents for the operating personnel. By being bound to the floor, railborne systems of this type are highly susceptible to faults in the event of casting faults caused by escaping liquid steel.

It is also known to arrange on the casting plant automated devices which, as a consequence of design, perform only a single activity. A device of this type is known for example, from U.S. Pat. No. 5,067,553, which comprises a casting powder feed device on the jib of a turret. After the hot bath level surface has been detected, the casting powder is conducted by means of a movable gripping arm out of a casting powder container through a flexible line onto the bath level surface.

SUMMARY OF THE INVENTION

The object on which the present invention is based is, therefore, to avoid the disadvantages of the known prior art and to propose a continuous casting plant having at least one multifunction robot, in which, with few multifunction robots being used, a multiplicity of continuously recurring activities can be carried out accurately and in an automated manner on a continuous casting plant, without access to the casting plant for the operating personnel being obstructed or an additional accident risk arising on account of the multifunction robots. Further, the multifunction robots are to be positioned such that, even in the event of operating faults, such as, for example, a run-out of liquid metal, they are subject to as low a risk of damage as possible.

Proceeding from a device of the type initially described, this object is achieved in that the or each multifunction robot is arranged on a pivoting arm of a rotary column fastened on the casting platform of the continuous casting plant and can be pivoted by means of the pivoting arm between a retraction position and a working position.

In defining a plurality of working regions on the continuous casting plant, it is important essentially to delimit these working regions spatially with respect to one another and fix the working position of the multifunction robot in each working region. A working position is to be understood here as meaning one or more basic positions which the multifunction robot assumes in relation to the casting plant. In this case, it is located on the pivoting arm of a rotary column, in a first embodiment of the pivoting arm the first axis of rotation of the multifunction robot running parallel to the axis of rotation of the pivoting arm of the rotary column and at a distance from this. In a second embodiment of the pivoting arm, the latter is formed by a parallel link system, and the first axis of rotation of the multifunction robot stands normally to the pivot axes of the parallel links. Even a combination of the two embodiments may be envisaged. By an appropriate choice of the pivoting arm length, the rotary column is anchored outside the immediate vicinity of the working region of the respective multifunction robot and, after the multifunction robot has been pivoted out into its retraction position, allows unobstructed access to this working region for the operating personnel of the casting plant. If a plurality of working positions are assigned to one multifunction robot, these are located on the pivoting circle of the pivoting arm which is determined by the position of the multifunction robot.

A plurality of basic forms of the design of a rotary column with a pivoting arm are expedient in this context: the pivoting arm may be connected rigidly to the rotatable rotary column, the rotary column being supported on a rotary bearing, and the rotary column being assigned a rotary drive comprising a motor and a gear. Further, the pivoting arm may be mounted rotatably on the rotary column, and the pivoting arm is assigned a rotary drive. Thirdly, there is the possibility that the pivoting arm is formed by a parallel link system, the parallel link system being assigned a pivoting drive.

Even two or more working regions may be assigned to one multifunction robot. As a result, on the one hand, it becomes possible for one multifunction robot to assume the function of another multifunction robot, for example in the event of its failure, and, on the other hand, if there is an appropriately overlapping range of adjacent multifunction robots, a regrouping of the activities of individual robots can be carried out as a function of the workload.

So that a plurality of multifunction robots can be positioned in optimal working positions, in an expedient embodiment at least one multifunction robot is arranged on a pivoting arm of a rotary column at a height which deviates from the height of a multifunction robot on a further pivoting arm of a rotary column.

The height of a multifunction robot may also be configured variably if the rotary column is designed as a lifting element. This may take place, for example, by means of the arrangement of lifting cylinders or by means of a telescopic construction of the lifting column.

Each multifunction robot is assigned a supply region for the reception and deposition of tools, operating stock and the like. This supply region comprises, for example, magazines, in which tools, materials to be used and operating stock are arranged unequivocally and in a grippable and detectable way for the gripping tools and the sensors of the multifunction robot and, if appropriate, can also be deposited there again. These supply regions are arranged in the multifunction robot range which is widened by means of the rotary column.

According to an expedient embodiment, the supply region may likewise be arranged on the pivoting arm of a rotary column, and this supply region is preferably pivotable between a position of use in the range of the multifunction robot and a loading position. In this case, the supply region may be arranged on a second pivoting arm of a rotary column which already has a pivoting arm with a robot, the two pivoting arms preferably being pivotable independently of one another. The supply region may, however, also be arranged on the pivoting arm of a separate rotary column, the position of use of this supply region lying in the range of one or more multifunction robots.

The selection of the working regions on the continuous casting plant takes place, on the one hand, according to spatial factors and, on the other hand, according to the prevailing time of use of the multifunction robot in the respective working region. Further, particularly in the retrofitting of existing continuous casting plants, it is influenced essentially by the existing structural conditions.

For example, working regions for essential core components and activity zones may be proposed:

- ladle turret surroundings,
- casting ladle surroundings, in particular the region of the spout and of the ladle slide, etc.,
- tundish surroundings, in particular the region of the immersion spout and of the ladle slide or of the tundish plug etc.,
- mold surroundings, in particular bath level observation, casting powder feed, temperature measurement etc.,
- flame-cutting machine, in particular burner guidance, local cooling, surface inspection, etc.,
- deburring and marking surroundings, in particular whisker removal, placing of markings,
- quality control in the run-out region of the continuous casting plants, in particular visual inspection, flame descaling, sampling, etc.

Where multistrand continuous casting plants are concerned, working regions of this type may be defined separately for each strand or else jointly for a plurality of strands.

A multiplicity of activities arise within the working regions for the assigned multifunction robot, for example, there are the following possible activities for the working regions "casting ladle surroundings", "tundish surroundings" and "mold surroundings":

Activities in the casting ladle surroundings:
- detection of the casting ladle position,
- activation of the ladle slide shutter,
- fastening and removal of the spout,
- coupling and decoupling of the media lines and couplings.

Activities in the tundish surroundings:
- detection of the casting ladle position,
- fastening and removal of the spout,
- opening of the ladle with an oxygen lance,
- cleaning of the spout,
- changing of the spout,
- temperature measurement in the tundish,
- sampling in the tundish,
- feed of casting powder in the tundish,
- bath level measurement in the tundish.

Activities in the mold surroundings:
- detection of the tundish position,
- sampling in the mold,
- casting powder feed in the mold,
- casting spout preheating,
- casting spout change,
- slag removal from the mold,
- insertion of separating plates in sequential casting,
- cooling of the strand end or mold cleaning at the end of casting,
- placing and removal of splash protection devices,
- execution of temperature measurements.

The partial overlap of activities in the assignment to the working regions makes it possible to bring together working regions or the processing in these by means of multifunction robots which are assigned to adjacent working regions.

Preferably, the multifunction robots and the rotary columns and pivoting arms carrying them are of modular construction. They form subassemblies which are interchangeable, as desired, with the result that a rapid change and maintenance of the assemblies becomes possible even during continuous casting operation.

Expediently, the multifunction robot is equipped with a data transmission and data reception device, and this is connected to a central management device or to a process computer of the continuous casting plant.

BRIEF DESCRIPTION OF THE DRAWINGS

Further advantages and features of the present invention may be gathered from the following description of unrestricting exemplary embodiments, reference being made to the accompanying figures in which.

DESCRIPTION OF PREFERRED EMBODIMENTS

Figure 1A:
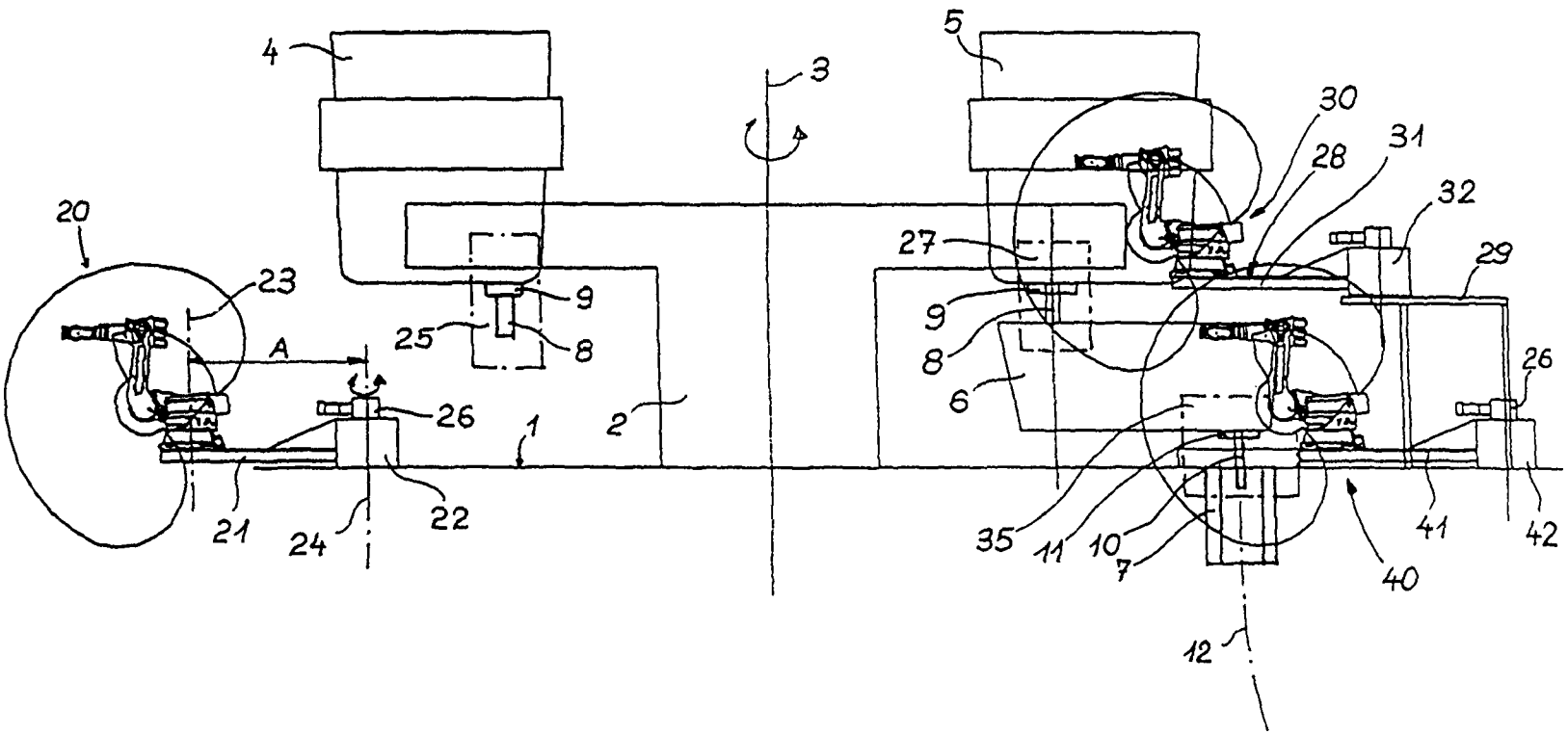
FIG. 1*a* shows the liquid phase region of a continuous casting plant with the arrangement according to the invention of three multifunction robots in elevation in a diagrammatic illustration.
Figure 1B:
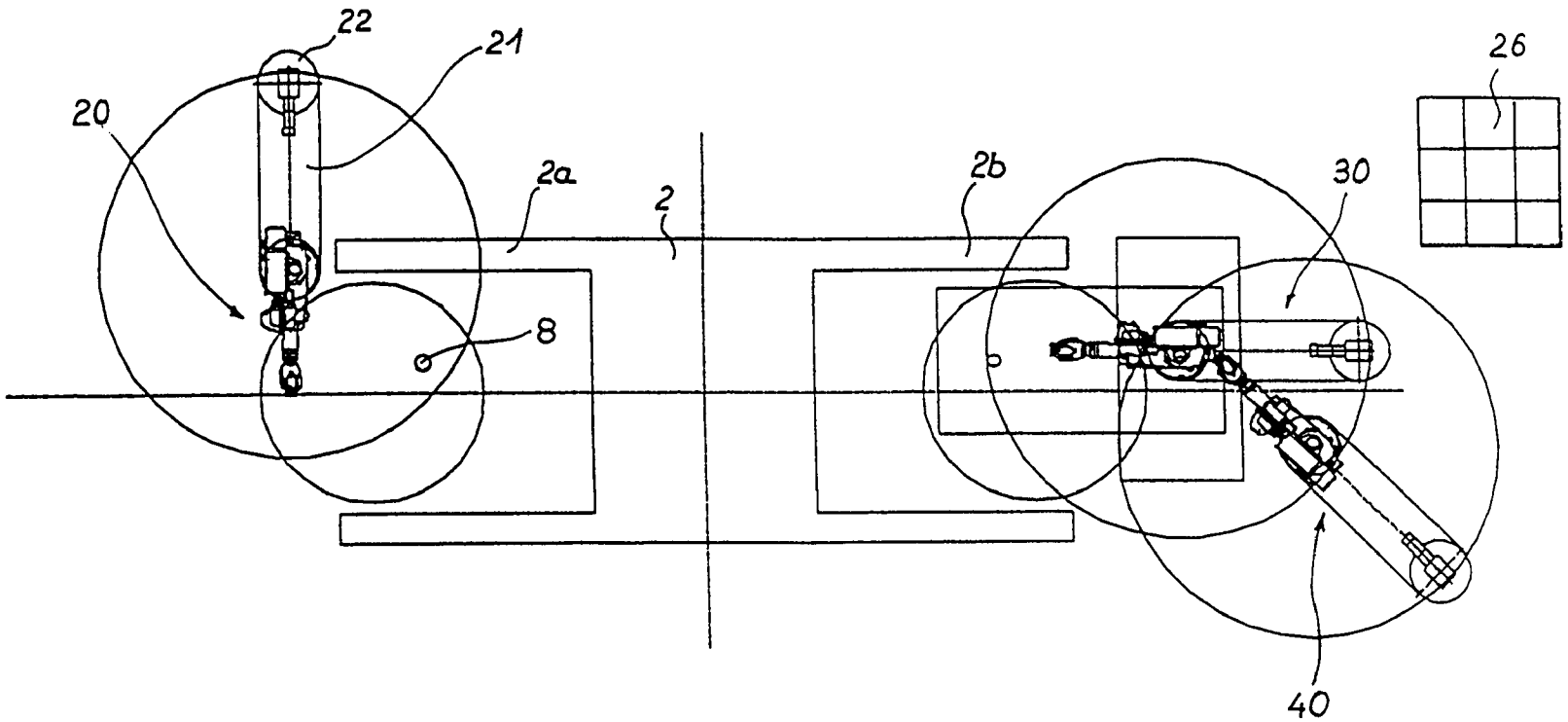
FIG. 1*b* shows the liquid phase region of a continuous casting plant with the arrangement according to the invention of three multifunction robots according to FIG. 1*a* in horizontal projection in a diagrammatic illustration.

FIGS. 1*a* and 1*b* make clear in diagrammatic illustrations the situation on the casting platform of a continuous casting plant, such as is used, for example, in the production of a steel strand of slab cross section.

A ladle turret 2 is supported rotatably about a vertical axis 3 on the casting platform 1 of the continuous casting plant. Casting ladles 4, 5 for supplying the casting plant with steel melt are suspended in fork arms 2*a*, 2*b* directed away from one another. The casting ladle 5 is located, in the casting position, above a tundish 6, and this, in turn, is located, in a casting position, above the continuous casting mold 7. During the casting operation, steel melt flows out of the casting ladle 5 through a spout 8, to which a slide shutter 9 is assigned, into the tundish 6 and from there through the immersion spout 10, to which a slide shutter 11 is assigned, into the continuous casting mold 7. An at least partially solidified steel strand, which is indicated by the curved center line 12, emerges from the continuous casting mold 7 and runs in a known way through the strand guide of the continuous casting plant.

The continuous casting plant is assigned, on the casting platform 1, three multifunction robots 20, 30, 40 which are designed as 6-axis robots and each of which is fastened independently on the assigned pivoting arm 21, 31, 41 of a rotary column 22, 32, 42. The multifunction robot 20 is assigned a first axis of rotation 23 which is fixed at a distance A from the vertical axis of rotation 24 of the rotary column 22 and which fixes the position of the multifunction robot with respect to the axis of rotation 24. In FIG. 1*a*, the multifunction robot 20 is illustrated in its retraction position, and in FIG. 1*b* it is illustrated in its working position and in this working position can carry out manipulations in the working region 25 (casting ladle surroundings) of the casting ladle 4, such as, for example, the detection of the casting ladle position or of the position of the ladle slide 9 and the fastening of the spout 8. The rotary column 22 is fastened on the casting platform 1 preferably by means of a releasable screw connection, so that the rotary column, together with the multifunction robot, can easily be removed, as required. Magazines for the reception of tools and operating stock of the supply region 26 are arranged directly on the rotary column 22. The basic structural set-up of the rotary column together with the pivoting arm and multifunction robot is identical for the robots 20, 30 and 40.

The multifunction robot 30 is assigned to the working region 27 (tundish surroundings) and in this case can carry out activities in this region, such as, for example, the change of a spout 8 on the bottom of the casting ladle 5 or else sampling in the tundish 6. According to its working region 27 on the continuous casting plant, the multifunction robot 30 is arranged at a height 28 elevated with respect to the multifunction robot 20. It would be perfectly possible that the rotary column 32 is not fastened on a carrying frame 29, as illustrated, but that the rotary column 32 extends onto the casting platform 1 and is fastened there.

The multifunction robot 40 is assigned to the working region 35 (mold surroundings) and can in this case carry out activities in this region, such as, for example, the change of the immersion spout 10 or the execution of sampling in the continuous casting mold 7. Magazines of the supply region 26, 26*a* may be attached both directly on the rotary column 42 and to one side on the casting platform 1, the supply region 26*a* being capable of being reached both by the multifunction robot 30 and by the multifunction robot 40.

Figure 2A:
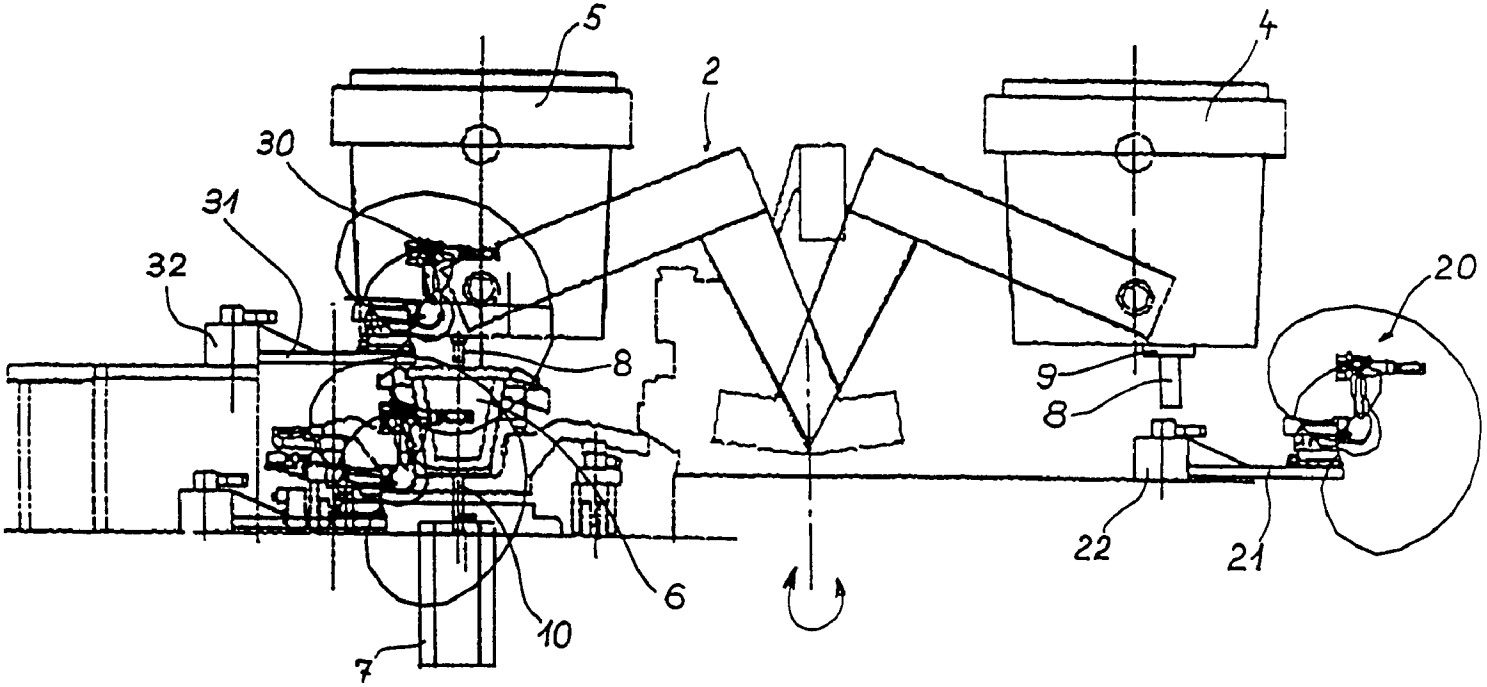
FIG. 2*a* shows the liquid phase region of a continuous casting plant with the arrangement according to the invention of four multifunction robots in elevation in a diagrammatic illustration.
Figure 2B:
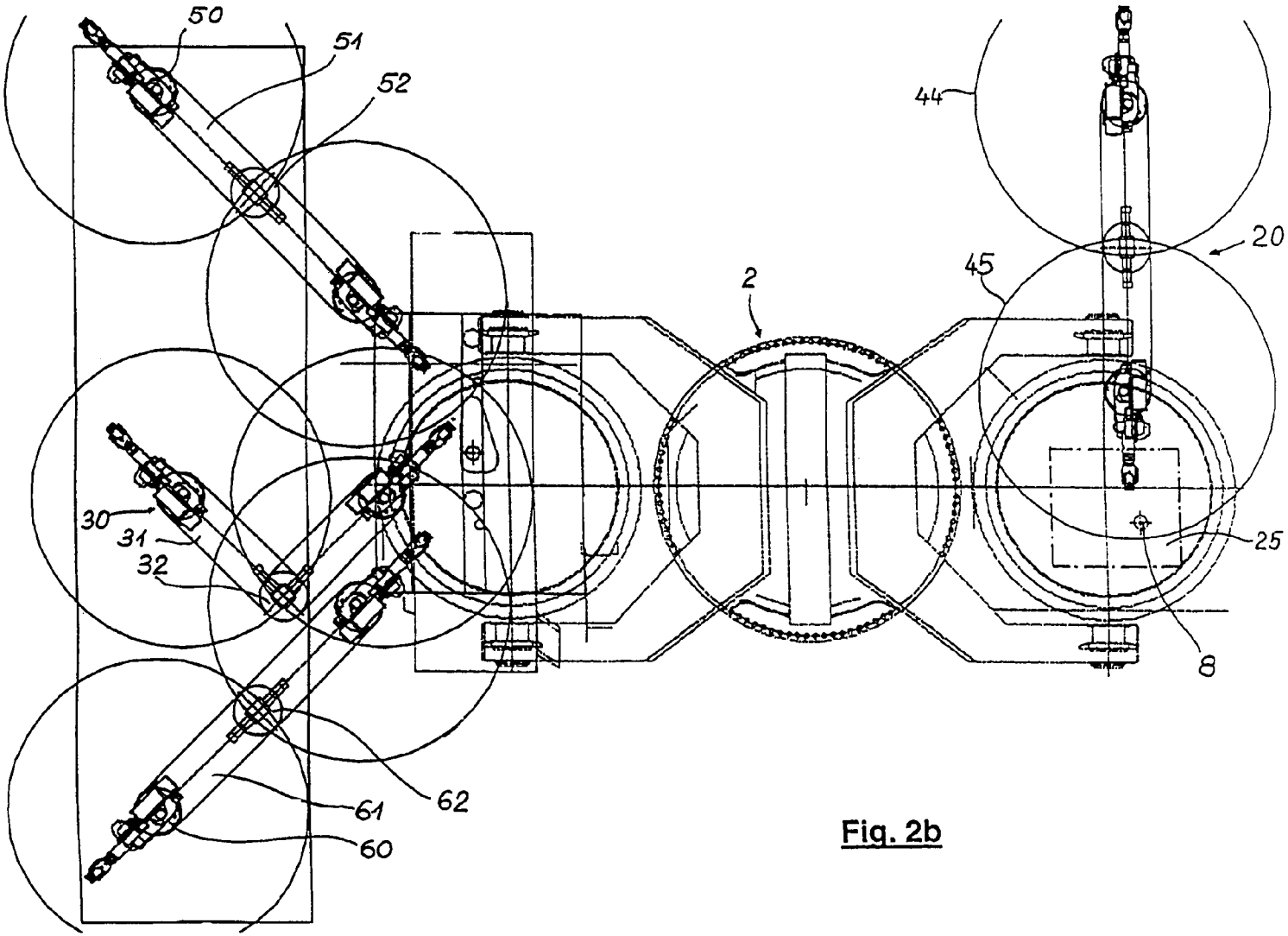
FIG. 2*b* shows the liquid phase region of a continuous casting plant with the arrangement according to the invention of four multifunction robots according to FIG. 2*a* in horizontal projection in a diagrammatic illustration.

FIGS. 2*a* and 2*b* illustrate diagrammatically a possible arrangement of four multifunction robots on the casting platform of a continuous casting plant, which could be, here, on the one hand, a continuous casting plant for the production of very wide slabs or, on the other hand, a continuous casting plant for the casting of two or more steel strands. The reference symbols for components which occur both in the illustrations according to FIG. 1*a* and FIG. 1*b* and in the illustrations according to FIGS. 2*a* and 2*b* are identical.

In FIGS. 2*a* and 2*b*, once again, a ladle turret 2 rotatable about a vertical axis 1 and carrying casting ladles 4, 5 is illustrated. The casting ladle 4 is assigned a multifunction robot 20 on the carrying arm 21 of a rotary column 22, by means of which multifunction robot activities in the working region 25 (casting ladle surroundings) of the casting ladle 4 can be carried out, such as, for example, the detection of the casting ladle position or of the position of the ladle slide 9. Circles 44, 45 outline the range of the multifunction robot in its retraction position and in its working position.

The robot 30 is supported on the pivoting arm 31 of the rotary column 32 and is assigned to the working region "tundish surroundings" and can in this case carry out activities in this region, such as, for example, the change of a spout 8 on the bottom of the casting ladle 5 or else sampling in the tundish 6.

The multifunction robot 50 is supported on a pivoting arm 51 of the rotary column 52 and the multifunction robot 60 is supported on a pivoting arm 61 of the rotary column 62. Both multifunction robots 50, 60 are assigned to the working region "mold surroundings" and can in this case carry out activities in this region, such as, for example, the change of the immersion spout 10 or the execution of sampling in the continuous casting mold 7. It is clear from FIG. 2*b* that the working regions, which are derived from the working position of the two robots 50, 60, lie next to one another and correspondingly cover the working region on a very long tundish 6, with, for example, two immersion spouts 10 arranged one behind the other in the image plane of FIG. 2*a*, or else the working regions of two continuous casting molds 7 arranged one behind the other in the image plane of FIG. 2*a*.

Figure 3:
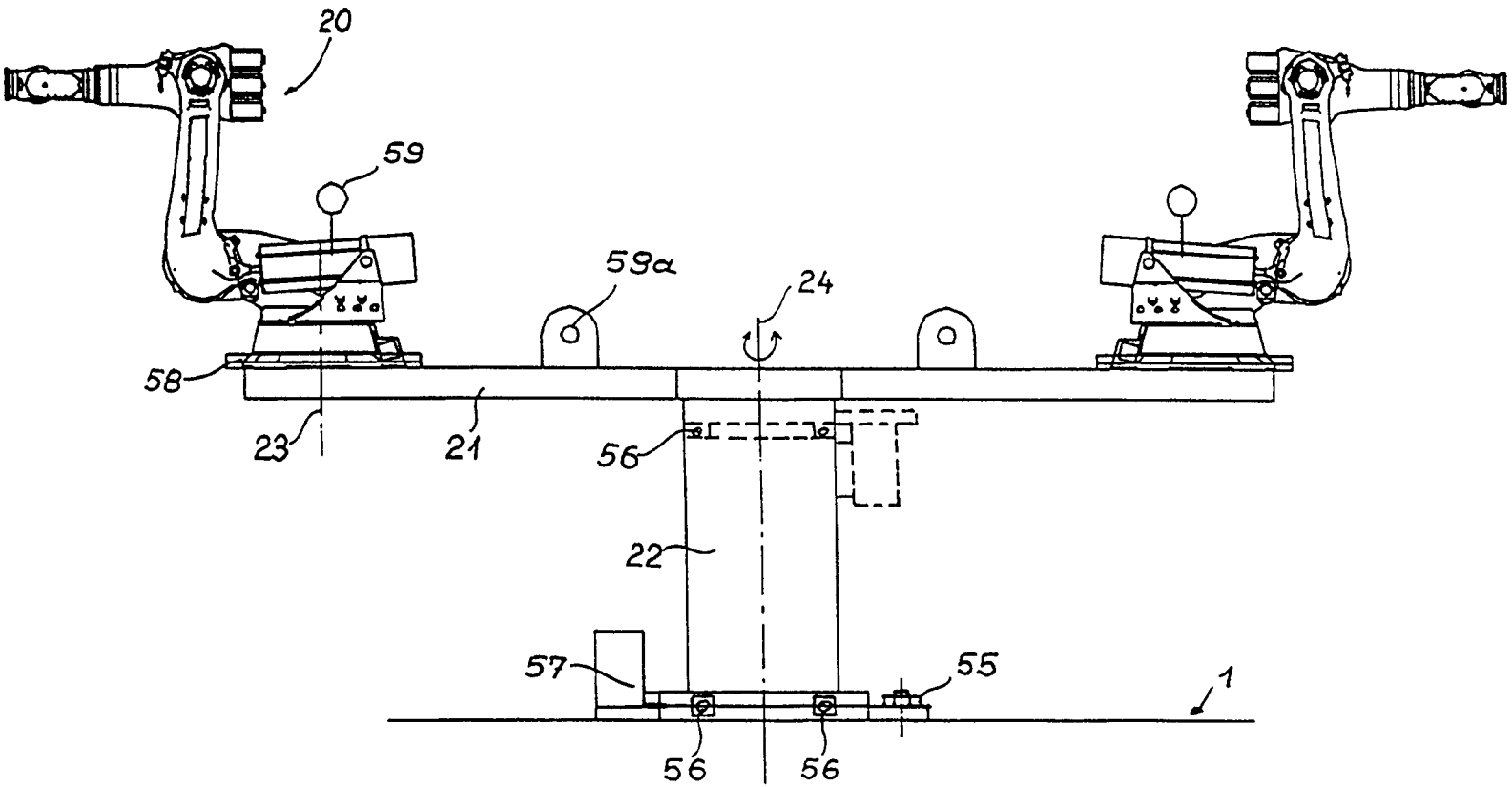
FIG. 3 shows the rotary column with a pivoting arm in a possible basic form of the configuration.

FIG. 3 illustrates a multifunction robot 20 in a working position (left image half) and in a retraction position (right image half) on the pivoting arm 21 of a rotary column 22. The rotary column 22 is fastened releasably on the casting platform 1 by means of a baseplate 54 by a plurality of tension means 55. The rotary column 22 is supported on the baseplate 54 rotatably about the vertical axis 24 via rotary bearings 56 and is connected to a drive device 57, here especially to a drive motor (electric drive motor), via a gear, not illustrated in any more detail. Fastened on the rotary column is a pivoting arm 21 carrying the multifunction robot 20, the first axis of rotation 23 of which is oriented parallel to the axis of rotation 24. In a variant, illustrated by dashes, of the rotary column design, the rotary column 22 projects in a stationary manner upward from the baseplate 24, and a rotary bearing 56' is arranged just beneath the pivoting arm 21 or between the rotary column and the pivoting arm, so that only the pivoting arm 21 is moved by the drive device 57', likewise depicted by dashes.

Both the multifunction robot 20 and the rotary column 22 with a pivoting arm 21 are designed as quick-changeable subassemblies. The multifunction robot is placed by means of a quick-action release mechanism 58 in the manner of a bayonet fastening on the projecting end of the pivoting arm 21 and, after the release of the bayonet fastening, can be lifted off by the indoor crane by means of the raising device 59 and set down at a service station or on another pivoting arm. The pivoting arm 21 is likewise equipped with a raising device 59*a* which, after the opening of the tension means 55, makes it possible to manipulate the rotary column and the pivoting arm.

Figure 4:
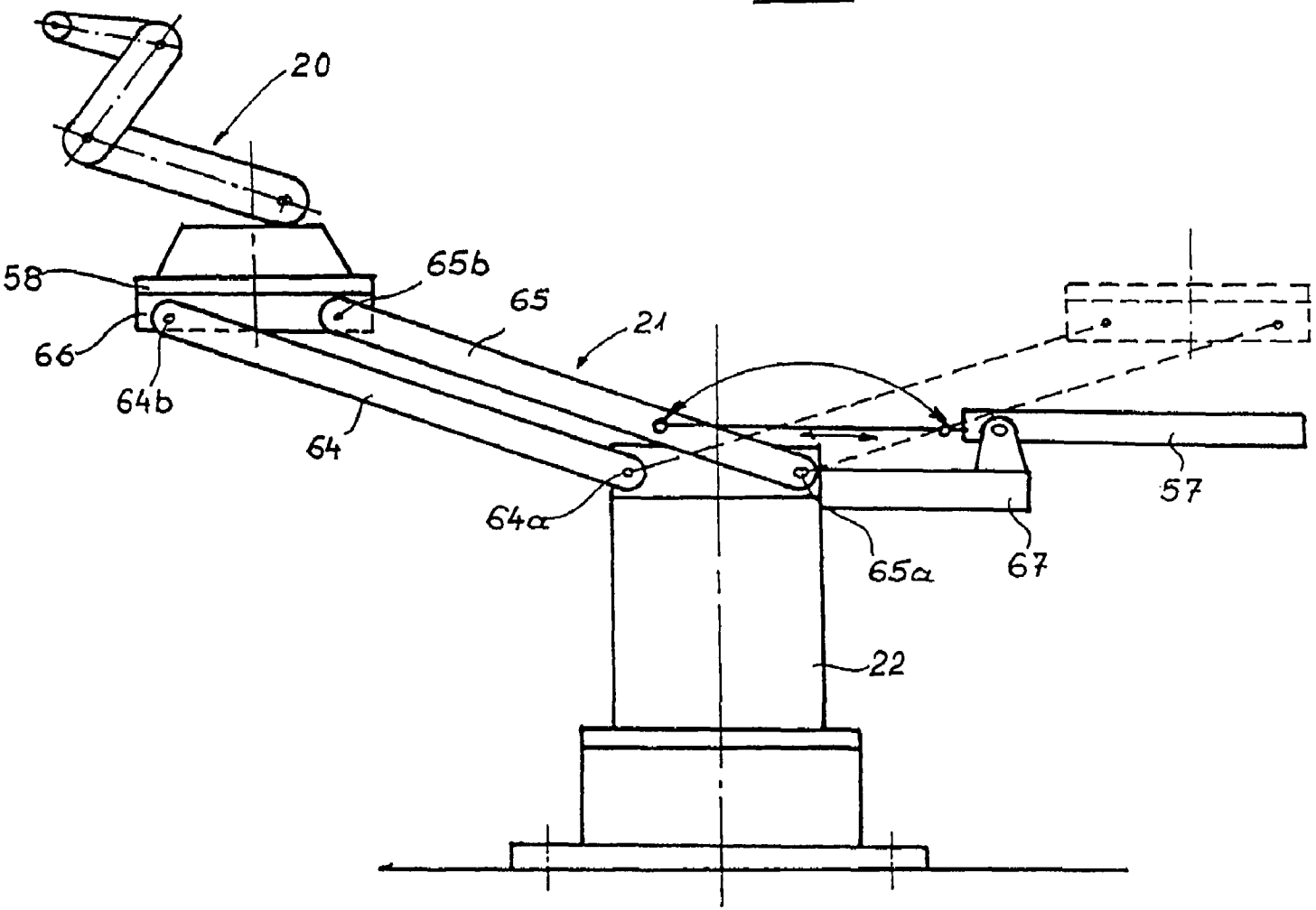
FIG. 4 shows the rotary column with a pivoting arm in a further basic form of the configuration.

FIG. 4 shows a further variant of a rotary column 22 with a pivoting arm 21 for the reception of a multifunction robot 20. The rotary column 22 is stationary and the pivoting arm 21 is formed by two parallel links 64, 65 which are supported, on the one hand, on the rotary column 22 pivotably about horizontal axes 64*a*, 65*a* and, on the other hand, on a carrying plinth 66 pivotably about horizontal axes 64*b*, 65*b*. The drive device 57 is formed by a pressure medium cylinder and engages on one of the parallel links 65 and is itself supported on a bracket 67 of the rotary column 22. The multifunction robot 20 is placed on the carrying plinth 66 and is fastened by means of a quick-action release mechanism 58.

Figure 5:
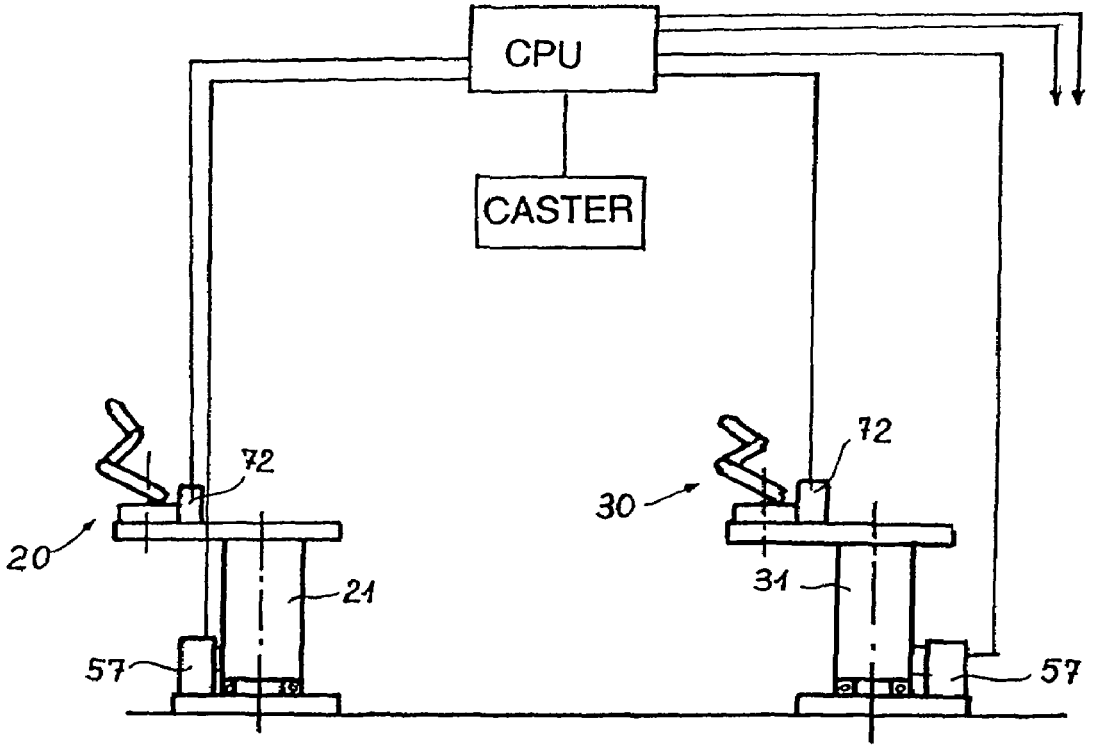
FIG. 5 shows a circuit diagram for incorporating the multifunction robots into the process management level of the plant control.

FIG. 5 shows the incorporation of the multifunction robots 20, 30 and of the drive devices 57 of the rotary columns 21, 31 into the process and plant control 71 of the continuous casting plant. By measuring and regulating devices 72, not illustrated in any more detail, but conventional in multifunction robots, such as comprise, for example, image recorders, image evaluation devices, displacement transducers and drive assemblies for the individual axes of rotation of the robot, and also by the drive devices 57, measurement signals are transmitted to a process computer of the plant control 71, and are processed there, and control signals coordinated with the process management of the continuous casting plant are sent to the multifunction robots 20, 30 and the drive devices 57.

The invention claimed is:

1. A continuous casting plant having a casting platform and at least one multifunction robot positioned on the casting platform, the casting plant comprising:

the at least one multifunction robot configured to perform automatically and independently at least one action of a plurality of different process-controlled or automated actions on the continuous casting plant;

at least one working region defined on the continuous casting plant, and each working region being assigned at least a respective one of the at least one multifunction robot;

a pivoting device pivotable in the plant, and the pivoting device including a pivoting arm pivotable by the pivoting device, the at least one robot being positioned on top of the pivoting arm and the arm is configured to move the at least one robot into and away from the respective working region;

the pivoting device comprising a rotary column fastened on the casting platform of the continuous casting plant and having a rotation axis;

the pivoting arm is supported rotatably on the rotary column and projecting out from and rotatable about the rotation axis of the column, so that the at least one robot is pivotable between a retraction position and a working position by the pivoting arm; and a drive device configured to rotate the pivoting arm about the rotation axis.

2. The continuous casting plant as claimed in claim 1, further comprising a second working region, and wherein the pivoting arm is positioned and configured to move the at least one robot at the pivoting arm between the working region and the second working region.

3. The continuous casting plant as claimed in claim 1, comprising a second pivoting arm positioned at the rotary column and a second multifunction robot configured to perform automatically and independently at least one action of the plurality of different process-controlled or automated actions on the continuous casting plant, the second multifunction robot positioned on the second pivoting arm, the second pivoting arm configured to move the second robot into and away from a second working region;

the at least one multifunction robot arranged on the pivoting arm at the rotary column and at a height which is different from the height of the second multifunction robot arranged on the second pivoting arm.

4. The continuous casting plant as claimed in claim 1, wherein the rotary column is rotatable, and the pivoting arm is connected rigidly to the rotatable rotary column.

5. The continuous casting plant as claimed in claim 1, wherein the pivoting arm comprises a parallel link system, and a drive device for operating the parallel link system to move the at least one robot by operating the link system.

6. The continuous casting plant as claimed in claim 1, wherein the rotary column comprises a lifting element for the pivoting arm.

7. The continuous casting plant as claimed in claim 1, further comprising a supply region for reception and deposition of tools, operating stock and other elements, and the supply region is positioned for being accessed by the at least one robot moved to the supply region.

8. The continuous casting plant as claimed in claim 7, wherein the supply region is arranged on the pivoting arm which is at the rotary column, and the supply region is pivotable between a first position of use in the range of the at least one robot and a loading position.

9. A continuous casting plant having a casting platform and at least one multifunction robot positioned on the casting platform, the casting plant comprising:

the at least one multifunction robot configured to perform independently and automatically at least one action of a plurality of different process-controlled or automated actions on the continuous casting plant;

at least one working region defined on the continuous casting plant, and each working region being assigned at least a respective one of the multifunction robots;

a pivoting device pivotable in the plant, and the pivoting device including a pivoting arm pivotable by the device, a respective one of the robots being positioned on top of the pivoting arm and the pivoting arm is configured to move the at least one robot into and away from the respective working region;

a rotary column fastened on the casting platform of the continuous casting plant and having a rotation axis;

the pivoting arm is supported rotatably on the rotary column and projecting out from and rotatable about the rotation axis of the column, so that the at least one multifunction robot is pivotable between a retraction position and a working position by the pivoting arm, wherein there are a plurality of defined working regions which comprise the working region selected from the group consisting of:

ladle turret surroundings, casting ladle surroundings, tundish surroundings, mold surroundings, flame-cutting machine, deburring and marking surroundings, and quality control in a run-out region of the continuous casting plant.

10. A continuous casting plant having a casting platform and at least one multifunction robot positioned on the casting plate, the casting plant comprising:

the at least one multifunction robot configured to perform independently and automatically at least one action of a plurality of different process-controlled or automated actions on the continuous casting plant;

at least one a working region defined on the continuous casting plant, and each working region being assigned at least a respective one of the multifunction robots;

a pivoting device pivotable in the plant, and the pivoting device including a pivoting arm pivotable by the device, a respective one of the robots being on top of the pivoting arm and the arm is configured to move the at least one robot into and away from the respective working region;

a rotary column fastened on the casting platform of the continuous casting plant and having a rotation axis;

the pivoting arm is supported rotatably on the rotary column and projecting out from and rotatable about the rotation axis of the column, so that the at least one robot is pivotable between a retraction position and a working position by the pivoting arm, wherein the at least one robot and the rotary column with the pivoting arm comprise exchangeable subassemblies, and quick-action release mechanisms between the subassemblies.

11. The continuous casting plant as claimed in claim 1, wherein the at least one robot is equipped with a data transmission and data reception device connected to a central management device or to a process computer of the continuous casting plant.

12. The continuous casting plant as claimed in claim 4, further comprising a drive device connected with the rotary column for driving rotation thereof.

13. The continuous casting plant as claimed in claim 9, wherein the casting ladle surroundings are in a region of a spout.

14. The continuous casting plant as claimed in claim 1, wherein the at least one robot is configured to rotate about a first axis with respect to the pivoting arm, and wherein the first axis is parallel to the rotation axis of the rotary column.

15. The continuous casting plant as claimed in claim 1, wherein the robot is configured to rotate about a first axis with respect to the pivoting arm, and wherein the first axis is normal to the rotation axis of the rotary column.

16. The continuous casting plant as claimed in claim 1, wherein the at least one multifunction robot is configured to perform automatically and independently a detection of a position of an object.

17. The continuous casting plant as claimed in claim 9, wherein at least one the robot is configured to rotate about a first axis with respect to the pivoting arm.

18. The continuous casting plant as claimed in claim 9, wherein at least one the robot is configured to rotate about a first axis with respect to the pivoting arm, and wherein the first axis is parallel to the rotation axis of the rotary column.

19. The continuous casting plant as claimed in claim 10, wherein the at least one robot is configured to rotate about a first axis with respect to the pivoting arm.

* * * * *